US005588174A

United States Patent [19]

Godfrey

[11] Patent Number: 5,588,174

[45] Date of Patent: Dec. 31, 1996

[54] DISPOSABLE HAZARDOUS MEDICAL WASTE COLLECTION SYSTEM

[76] Inventor: Geoffrey L. Godfrey, 9006 E. Camino Del Santo, Scottsdale, Ariz. 85260

[21] Appl. No.: 520,208

[22] Filed: Aug. 21, 1995

[51] Int. Cl.[6] ..... A47L 13/52

[52] U.S. Cl. ..... 15/257.2; 15/159.1; 15/257.1

[58] Field of Search ..... 15/104.8, 159.1, 15/257.1–257.9

[56] References Cited

U.S. PATENT DOCUMENTS

| | | | |
|---|---|---|---|
| 3,382,523 | 5/1968 | Parsisson | 15/257.2 |
| 3,408,681 | 11/1968 | Isakson | 15/257.2 |
| 3,534,424 | 10/1970 | Levinson | 15/257.1 |
| 3,639,937 | 2/1972 | Sweeney | 15/104.8 |
| 3,765,044 | 10/1973 | Hanahan et al. | 15/257.2 |

FOREIGN PATENT DOCUMENTS

| | | | |
|---|---|---|---|
| 457268 | 2/1928 | Germany | 15/257.2 |
| 447014 | 5/1936 | United Kingdom | 15/257.2 |

*Primary Examiner*—Mark Spisich

[57] ABSTRACT

A disposable dust pan (10) provides single use applications, for example in medical environments, to allow safe collection of hazardous waste. The dust pan has a handle portion (12) and a collecting portion (14). The handle portion has an first elongated opening (16) for fingers and a substantially circular second opening (18) for the thumb. The dust pan is tapered along its sides to provide support and a holding area for the waste material. The collecting portion is provided on both sides for right hand or left hand use. A sweeper (20) is housed in the collecting portion and has three rows of closely packed bristles (22). A ridge (24) extends above the flat portion of the collecting portion and prevents the hazardous waste from falling out of the collecting portion. The dust pan is made from recycled paper products and heat-fired to provide a slick and sterile surface and the sweeper is made of recycled plastic products.

5 Claims, 1 Drawing Sheet

DISPOSABLE HAZARDOUS MEDICAL WASTE COLLECTION SYSTEM

BACKGROUND OF THE INVENTION

The present invention relates in general to waste collectors and, more particularly, to a disposable hazardous medical waste collection system.

Dust pans have long been used to collect waste and debris. In medical applications, for example in cleaning operating rooms after a surgical procedure, such waste can include suture needles, bone chips, many types of sharp objects, and other hazardous detritus. The medical waste can be left on tables, counters, carts, floors, etc. Designated medical personnel, such as Nursing Assistants (NA), are assigned to clean up the dangerous waste during and after the procedure. The medical waste is hazardous to medical personnel in terms of potential cuts and puncture wounds, and the possible spread of disease and infection.

When cleaning up the hazardous waste, medical personnel have generally used industrial type implements such as "single use" mops, sponges, brooms and dust pans. The "single use" cleaning supplies need to be cleaned, disinfected, and sterilized after each use which is time consuming, unwieldy, and potentially harmful since hospital personnel must handle these implements. Alternately, the clean-up personnel could use left-over surgical gauze sponges and paper towels. However, such disposable clean-up supplies require the NAs to use their hands to pick up dangerous objects and thus expose themselves to serious injury and disease. The use of latex gloves cannot prevent puncture wounds from sharp objects.

Hence, a need exists for a disposable dust pan and sweeper that offers safety for clean-up personnel in a variety of hazardous waste applications.

DETAILED DESCRIPTION OF THE PREFERRED EMBODIMENT

Figure 1:
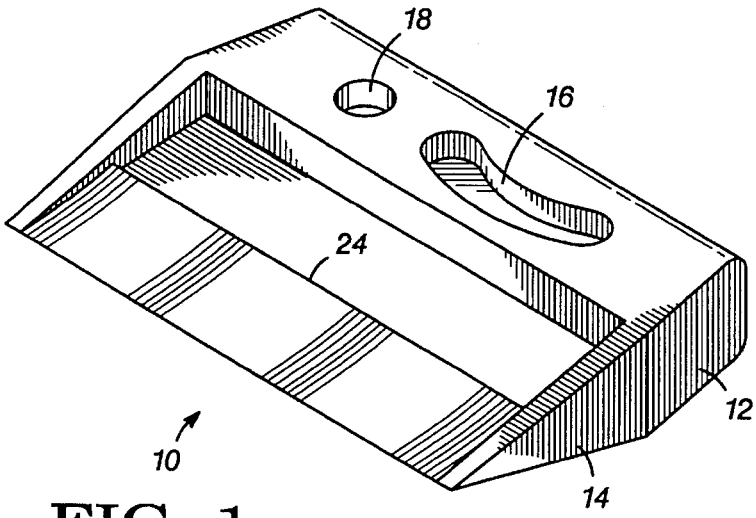
FIG. 1 is an isometric view of a disposable dust pan.

Referring to FIG. 1, a disposable hazardous medical waste collection system (disposable dust pan) 10 is shown in an isometric view. Dust pan 10 is disposable and intended for single use applications, for example in medical environments, to allow safe collection of hazardous detritus and waste left on hard surfaces. The medical waste includes suture needles, bone chips, cartilage, tissue, many types of sharp objects, and other hazardous detritus left on tables, counters, carts, floors, etc. for example following a surgical procedure in an operating room. Designated medical personnel, such as Nursing Assistants (NA), are assigned to clean up the dangerous waste during and after the procedure. The medical waste is hazardous to medical personnel in terms of potential cuts and puncture wounds, and the possible spread of disease and infection.

Figure 2:
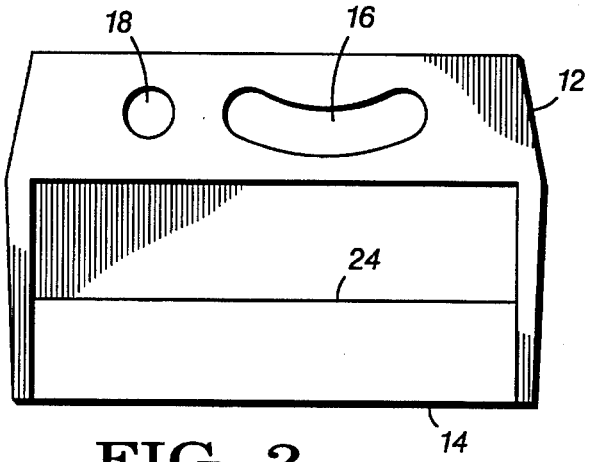
FIG. 2 is a top view of the disposable dust pan.

Dust pan 10 can be square or rectangular and includes a handle portion 12 measuring approximately 7.0 inches by 3.0 inches and a collecting portion 14 measuring approximately 6.5 inches by 4.0 inches as shown in top view FIG. 2. The thickness of dust pan 10 is approximately 1.0 inch. Handle portion 12 includes an first elongated opening 16 and a second substantially circular opening 18. Opening 16 comfortably fits four fingers of an adult hand for grasping dust pan 10. Circular opening 18 is intended for the thumb counter inserted with respect to the four fingers. Dust pan 10 may have other dimensions depending on the application.

Figure 3:
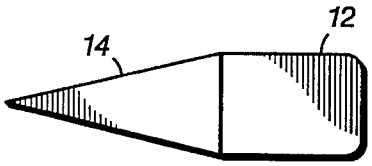
FIG. 3 is a side view of the disposable dust pan.

Dust pan 10 is tapered or angled along its sides as shown in side view FIG. 3 to provide support and a holding area for the waste material. A collecting portion 14 is provided on both sides of dust pan 10. The duplicate collection portion 14 allows the user to flip dust pan 10 to either side and use the right hand or the left hand with equal ease.

Figure 4:
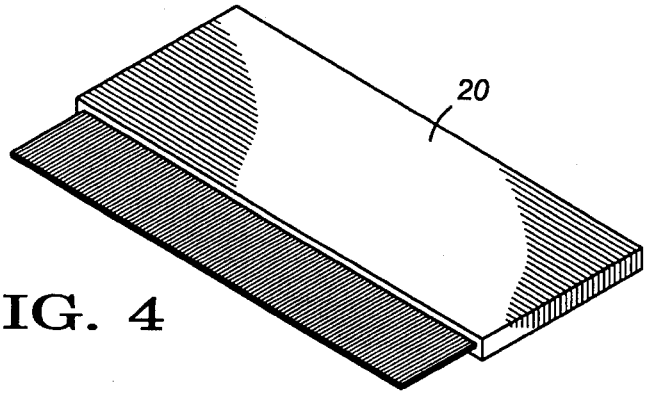
FIG. 4 is an isometric view of a disposable sweeper.

The function of disposable dust pan 10 is to collect and hold hazardous waste in collecting portion 14. A sweeper 20 shown in FIG. 4 includes three rows of closely packed bristles 22. Sweeper 20 is housed in collecting portion 14 until time of use. When hazardous waste needs to be cleaned up, sweeper 20 is removed from collecting portion 14 and held in one hand. Handle portion 12 is held in the opposite hand as described above. The user holds dust pan 10 to the hard surface and sweeps the waste into collecting portion 14. A ridge 24 extending above the flat plane of collecting portion 14 prevents the hazardous waste from falling out of collecting portion 14 should dust pan 10 be tipped down. Once the hazardous waste is held in collecting portion 14, the entire dust pan 10 including sweeper 20 is safely discarded into an appropriate hazardous waste receptacle. Thus, dust pan 10 is single use and disposable.

Dust pan 10 is made from recycled paper and heat-fired to provide a slick and sterile surface and the sweeper 20 is made of recycled plastic products.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. A disposable, single use collecting pan and brush comprising, in combination:

(a) a collecting pan made of recycled paper and which has leading portion, a trailing portion, opposite end portions extending between said leading and trailing portions, side walls at each end thereof which extend between said leading and trailing portions and which together cooperate with a dividing wall to define first and second holding areas located at respective top and bottom portions of the collecting pan for collecting and receiving debris therein; said trailing portion further including a gripping portion with a first elongated hole for receiving the user's fingers and a second hole for receiving the user's thumb;

(b) a brush made of recycled plastic and which comprises a substantially planar body having a plurality of bristles extending from and along a side edge thereof, said bristles being substantially coplanar with said body, said brush being adapted to fit into either one of said holding areas; and (c) the collecting pan being easily utilized by both right and left-handed persons by selecting a respective one of said holding areas and by facing the other of said holding areas to the surface being cleaned.

2. A disposable, single-use collecting pan adapted for use with a brush, comprising:

a collecting pan having a leading portion, a trailing portion, opposite end portions extending between said leading and trailing portions, side walls at each end thereof which extend between said leading and trailing portion and which together cooperate with a dividing wall to define first and second holding areas located at respective top and bottom portions of the collecting pan for collecting and receiving debris therein, said trailing portion further including a gripping portion with a first elongated hole for receiving the user's fingers, a ridge extending between the leading portion and the dividing wall at both the top and bottom portions of the collecting pan, said dividing wall further defining a plane which intersects the first elongated hole.

3. The collecting pan as recited in claim 2, further in combination with a brush which is adapted to be received by a portion of the collecting pan.

4. The collecting pan as recited in claim 2, wherein the collecting pan is made of recycled paper.

5. The collecting pan as recited in claim 2, wherein the gripping portion further includes a substantially circular hole for receiving the thumb of the user.

* * * * *